US011428446B2

(12) United States Patent
Yoshioka et al.

(10) Patent No.: US 11,428,446 B2
(45) Date of Patent: Aug. 30, 2022

(54) HEAT EXCHANGER UNIT

(71) Applicant: DAIKIN INDUSTRIES, LTD., Osaka (JP)

(72) Inventors: Shun Yoshioka, Osaka (JP); Yoshiyuki Matsumoto, Osaka (JP); Shouta Agou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 370 days.

(21) Appl. No.: 16/498,156

(22) PCT Filed: Mar. 22, 2018

(86) PCT No.: PCT/JP2018/011533
§ 371 (c)(1),
(2) Date: Sep. 26, 2019

(87) PCT Pub. No.: WO2018/180933
PCT Pub. Date: Oct. 4, 2018

(65) Prior Publication Data

US 2020/0033033 A1 Jan. 30, 2020

(30) Foreign Application Priority Data

Mar. 27, 2017 (JP) ..... JP2017-061204

(51) Int. Cl.
*F24H 3/06* (2022.01)
*F25B 31/00* (2006.01)
(Continued)

(52) U.S. Cl.
CPC ..... *F25B 31/006* (2013.01); *F25B 39/00* (2013.01); *F28D 1/053* (2013.01)

(58) Field of Classification Search
CPC ..... F25B 31/006; F25B 39/00; F28D 1/053; F28F 1/022
See application file for complete search history.

(56) References Cited

U.S. PATENT DOCUMENTS 5,529,116 A 6/1996 Sasaki et al.
7,757,753 B2 7/2010 Yanik et al.
(Continued)

FOREIGN PATENT DOCUMENTS

CN 103256757 A 8/2013
EP 2860483 A1 4/2015
(Continued)

OTHER PUBLICATIONS

Extended European Search Report issued in corresponding European Application No. 18775967.5 dated Feb. 24, 2020 (6 pages).
(Continued)

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

A heat exchanger unit includes: a first heat exchanger including a first header, a second header, and a first flat pipe group that includes first flat multi-hole pipes connected to each of the first header and the second header; and a second heat exchanger: disposed in parallel with the first heat exchanger on an air downstream side, from the first heat exchanger, of air flow generated by a fan; and including a third header, a fourth header, and a second flat pipe group that includes second flat multi-hole pipes connected to each of the third header and the fourth header. The fourth header causes a refrigerant that flows in from the third header to flow out to the first header.

7 Claims, 15 Drawing Sheets

(51) Int. Cl.
*F25B 39/00* (2006.01)
*F28D 1/053* (2006.01)

(56) References Cited

U.S. PATENT DOCUMENTS

| | | | | |
|---|---|---|---|---|
| 10,670,344 | B2 * | 6/2020 | Ito | F28F 1/022 |
| 2012/0255703 | A1 * | 10/2012 | Mishiro | F25B 39/00 165/11.1 |
| 2015/0083377 | A1 * | 3/2015 | Jindou | F28D 1/05375 165/143 |
| 2016/0054075 | A1 | 2/2016 | Taras | |
| 2016/0327343 | A1 * | 11/2016 | Hwang | F28D 1/0435 |
| 2017/0336145 | A1 | 11/2017 | Nakamura et al. | |
| 2018/0135900 | A1 | 5/2018 | Jindou et al. | |
| 2020/0072517 | A1 * | 3/2020 | Kato | F28F 9/262 |

FOREIGN PATENT DOCUMENTS

| | | | |
|---|---|---|---|
| EP | 2930450 | A1 | 10/2015 |
| EP | 3015808 | A1 | 5/2016 |
| JP | 2000-329486 | A | 11/2000 |
| JP | 2001-336896 | A | 12/2001 |
| JP | 2002-372383 | A | 12/2002 |
| JP | 2006-329511 | A | 12/2006 |
| JP | 2008-196811 | A | 8/2008 |
| JP | 2009-74754 | A | 4/2009 |
| JP | 2010-78234 | A | 4/2010 |
| JP | 2013-76521 | A | 4/2013 |
| JP | 2016-038192 | A | 3/2016 |
| JP | 2016-183850 | A | 10/2016 |
| JP | 2016205744 | A | 12/2016 |
| WO | 2013/183508 | A1 | 12/2013 |
| WO | 2015/037235 | A1 | 3/2015 |

OTHER PUBLICATIONS

International Search Report issued in corresponding International Application No. PCT/JP2018/011533, dated Jun. 12, 2018 with translation (4 pages).
International Preliminary Report on Patentability issued in corresponding International Application No. PCT/JP2018/011533 dated Oct. 10, 2019 (10 pages).

* cited by examiner

HEAT EXCHANGER UNIT

TECHNICAL FIELD

The present invention relates to a heat exchanger unit.

BACKGROUND

In recent years, a two-row-configuration heat exchanger that uses flat multi-hole pipes is mounted on an air-conditioning apparatus. For example, PTL 1 (Japanese Unexamined Patent Application Publication No. 2016-38192) discloses a heat exchanger unit formed such that the circulation direction of a refrigerant is opposite between a first parallel-flow-type heat exchanger disposed on an air upstream side of an air flow and a second parallel-flow-type heat exchanger disposed on an air downstream side thereof.

When the heat exchanger unit that has the aforementioned configuration is used as a condenser, however, air that has been heated by passing through a superheating region of the heat exchanger on the air upstream side flows into the heat exchanger on the air downstream side. In the heat exchanger on the air downstream side, a temperature difference is thus not easily assured between the air and the refrigerant, and an amount of the refrigerant to be cooled at a subcooling region is suppressed. In particular, when the flow of the refrigerant is opposite between the heat exchanger on the air upstream side and the heat exchanger on the air downstream side, the temperature difference between the air and the refrigerant is not easily assured at the subcooling region of the heat exchanger on the air downstream side. As a result, heat-exchanging performance of the air-conditioning apparatus is suppressed.

PATENT LITERATURE

PTL 1: Japanese unexamined Patent Application Publication No. 2016-38192

SUMMARY

One or more embodiments of the present invention provide a heat exchanger unit configured to improve heat-exchanging performance of an air-conditioning apparatus.

A heat exchanger unit according to one or more embodiments of the present invention includes a first heat exchanger and a second heat exchanger. The first heat exchanger includes a first header and a second header, and a first flat pipe group including a plurality of flat multi-hole pipes connected to each of the first header and the second header. The second heat exchanger is arranged in parallel with the first heat exchanger and disposed on an air downstream side, from the first heat exchanger, of an air flow generated by a fan. The second heat exchanger includes a third header and a fourth header, and a second flat pipe group including a plurality of flat multi-hole pipes connected to each of the third header and the fourth header. The fourth header causes a refrigerant that flows in from the third header to flow out to the first header.

In the heat exchanger unit according to one or more embodiments, the first heat exchanger is provided on an air upstream side, the second heat exchanger is provided on the air downstream side, and the fourth header on the air downstream side causes a refrigerant to flow out to the first header on the air upstream side. Thus, when the heat exchanger unit is used as a condenser, a refrigerant that flows in the second heat exchanger on the air downstream side can be subcooled at a first heat exchanging region, on the air upstream side. Consequently, when the heat exchanger unit is used as a condenser, it is possible to increase a temperature difference between a refrigerant and air with which heat is exchanged at the heat exchanger on the air upstream side, and it is thus possible to increase an amount of the refrigerant to be subcooled. As a result, it is possible to improve heat-exchanging performance of an air-conditioning apparatus.

In a heat exchanger unit according to one or more embodiments of the present invention, in the first flat pipe group, the plurality of the flat multi-hole pipes are arranged in an up-down direction, one or more of the flat multi-hole pipes on an upper side form an upper-side first heat exchanging region, and one or more of the flat multi-hole pipes on a lower side form a lower-side first heat exchanging region. An area of the upper-side first heat exchanging region is larger than an area of the lower-side first heat exchanging region. The first header includes an upper-side first header and a lower-side first header that are respectively connected to the upper-side first heat exchanging region and the lower-side first heat exchanging region. The fourth header causes a refrigerant that flows in from the third header to flow out to the lower-side first header.

In the heat exchanger unit according to one or more embodiments, the first heat exchanger including the upper-side first heat exchanging region and the lower-side first heat exchanging region is provided on the air upstream side, the second heat exchanger is provided on the air downstream side, and the fourth header on the air downstream side causes a refrigerant to flow out to the lower-side first header on the air upstream side. Thus, when the heat exchanger unit is used as a condenser, a refrigerant that flows in the second heat exchanger on the air downstream side can be subcooled at the lower-side first heat exchanging region on the air upstream side. Consequently, when the heat exchanger unit is used as a condenser, it is possible to increase a temperature difference between a refrigerant and air with which heat is exchanged at the heat exchanger on the air upstream side, and it is thus possible to increase an amount of the refrigerant to be subcooled. As a result, it is possible to improve heat-exchanging performance of an air-conditioning apparatus.

In a heat exchanger unit according to one or more embodiments of the present invention, the second header includes an upper-side second header and a lower-side second header that are respectively connected to the upper-side first heat exchanging region and the lower-side first heat exchanging region. A gas-refrigerant pipe that allows a gaseous refrigerant to flow therethrough is connected to the upper-side first header and the third header. A liquid-refrigerant pipe that allows a liquid refrigerant to flow therethrough is individually connected to the upper-side second header and the lower-side second header.

In the heat exchanger unit according to one or more embodiments, a direction of a refrigerant that flows in the upper-side first heat exchanging region and a direction of a refrigerant that flows in the lower-side first heat exchanging region are identical to each other. Thus, when the heat exchanger unit is used as a condenser, a superheating region and a subcooling region can be formed, in the first heat exchanger, at locations away from each other. Consequently, it is possible to suppress a heat conduction loss and further increase a degree of subcooling of the refrigerant.

In the heat exchanger unit that has the aforementioned configuration, the liquid-refrigerant pipe is individually connected to the upper-side second header and the lower-side second header. Thus, the upper-side second header and the upper-side first header do not require an intermediate pipe. Due to the configuration that does not require such an extra intermediate pipe, when the heat exchanger unit is used as an evaporator, it is possible to reduce a refrigerant pressure loss and a drifting flow that are caused by an intermediate branching flow and an intermediate pipe. As a result, it is also possible to improve the performance as the evaporator in the heat exchanger that has the aforementioned configuration.

In a heat exchanger unit according to one or more embodiments of the present invention, a first direction of a refrigerant that flows from the upper-side first header toward the upper-side second header and a second direction of a refrigerant that flows from the third header toward the fourth header are opposite to each other.

In the heat exchanger unit according to one or more embodiments, a flow direction of a refrigerant that flows in the upper-side first heat exchanging region and a flow direction of a refrigerant that flows in the second heat exchanger are opposite to each other. It is thus possible, when the heat exchanger unit is used as a condenser or an evaporator, to reduce temperature irregularity.

Meanwhile, when the flow direction of the refrigerant that flows in the upper-side first heat exchanger and the flow direction of the refrigerant that flows in the second heat exchanger are opposite to each other, a temperature difference is not easily assured between air that passes through the second heat exchanger and a refrigerant that flows in the second heat exchanger. In contrast, in the heat exchanger that has the aforementioned configuration, the fourth header on the air downstream side causes a refrigerant to flow out to the lower-side first header on the air upstream side, and thus, when the heat exchanger unit is used as a condenser, the subcooling region of the second heat exchanger can be disposed not to overlap from a space at the rear of the superheating region of the first heat exchanger. Consequently, when the heat exchanger unit is used as a condenser, it is possible to increase, in the second heat exchanger, the amount of the refrigerant to be cooled at the subcooling region.

In the heat exchanger unit that has the aforementioned configuration, the first header on the air upstream side and the fourth header on the air downstream side are close to each other. Consequently, it is possible to realize a structure that causes a refrigerant to easily flow out from the fourth header to the lower-side first header. In particular, as a result of the fourth header and the lower-side first header being disposed close to each other, it becomes easy to manufacture a heat exchanger unit that has a bent structure.

A heat exchanger unit according to one or more embodiments of the present invention further includes a coupling pipe that couples the fourth header and the first header to each other.

In the heat exchanger unit according to one or more embodiments, the coupling pipe that couples the fourth header and the first header to each other is further provided, and it is thus possible to form, when the heat exchanger unit is used as an evaporator, a refrigerant flow in which a refrigerant is blown up from below by adjusting (for example, connecting the coupling pipe to a lower portion of the upper-side fourth header) a connecting port of the coupling pipe and to reduce the drifting flow.

A state of a refrigerant that flows in the heat exchanger unit can be grasped by installing various measurement equipment at the coupling pipe. In addition, the heat-exchanging performance of the air-conditioning apparatus can be further improved by performing various adjustment on the basis of a value of this measurement.

In a heat exchanger unit according to one or more embodiments of the present invention, a temperature measurement device (temperature sensor) configured to measure a temperature of a refrigerant is installed at the coupling pipe.

In the heat exchanger unit according to one or more embodiments, the temperature measurement device is installed at the coupling pipe that couples the fourth header and the first header to each other, and it is thus possible to grasp a temperature of a refrigerant that flows in the second heat exchanger. The heat-exchanging performance of the air-conditioning apparatus can be further improved by optimizing the state of the refrigerant on the basis of a value of this measurement.

In a heat exchanger unit according to one or more embodiments, the first heat exchanger and the second heat exchanger are each bent at at least three portions thereof between the headers and each of the first heat exchanger and the second heat exchanger has a substantially quadrangular shape in plan view.

In the heat exchanger unit according to one or more embodiments, the first heat exchanger and the second heat exchanger are each bent at at least three portions thereof and each have a substantially quadrangular shape in plan view, and it is thus possible to realize an air-conditioning apparatus configured to supply conditioned air in a radial shape by installing a fan therein.

Note that "substantially quadrangular shape" referred here does not mean only a complete quadrangular shape and means any shape that is formed by pairs of two sides parallel to each other. Accordingly, the substantially quadrangular shape includes a quadrangular shape in which a corner portion or corner portions are rounded and a quadrangular shape in which a corner portion or corner portions are cut.

In a heat exchanger unit according to one or more embodiments of the present invention, the first heat exchanger and the second heat exchanger each have a shape that surrounds the fan.

In the heat exchanger unit according to one or more embodiments, the first heat exchanger and the second heat exchanger each have a shape that surrounds the fan, and it is thus possible to realize an air-conditioning apparatus configured to supply conditioned air in a radial shape.

The heat exchanger unit according to one or more embodiments can improve, when used as a condenser, heat-exchanging performance of an air-conditioning apparatus.

The heat exchanger unit according to one or more embodiments can improve, when used as a condenser, heat-exchanging performance of an air-conditioning apparatus.

The heat exchanger unit according to one or more embodiments can suppress a heat conduction loss and further increase a degree of subcooling of a refrigerant. In addition, the heat exchanger unit according to one or more embodiments can improve performance as the evaporator.

The heat exchanger unit according to one or more embodiments can reduce, when used as a condenser or an evaporator, temperature irregularity. In addition, when the heat exchanger unit is used as a condenser, the amount of a refrigerant to be cooled at a subcooling region can be further increased in the second heat exchanger.

The heat exchanger unit according to one or more embodiments can reduce, when used as an evaporator, a drifting flow.

The heat exchanger unit according to one or more embodiments can further improve heat-exchanging performance of an air-conditioning apparatus by optimizing a state of a refrigerant.

The heat exchanger unit according to one or more embodiments can realize an air-conditioning apparatus configured to supply conditioned air in a radial shape by installing a fan therein.

The heat exchanger unit according to one or more embodiments can realize an air-conditioning apparatus configured to supply conditioned air in a radial shape.

DETAILED DESCRIPTION

Hereinafter, embodiments of an air-conditioning apparatus according to the present invention, and modifications thereof will be described on the basis of the drawings. A specific configuration of the air-conditioning apparatus according to the present invention is not limited to the embodiments and the modifications thereof described below and can be changed within a range not deviating from the gist of the invention.

Figure 1:
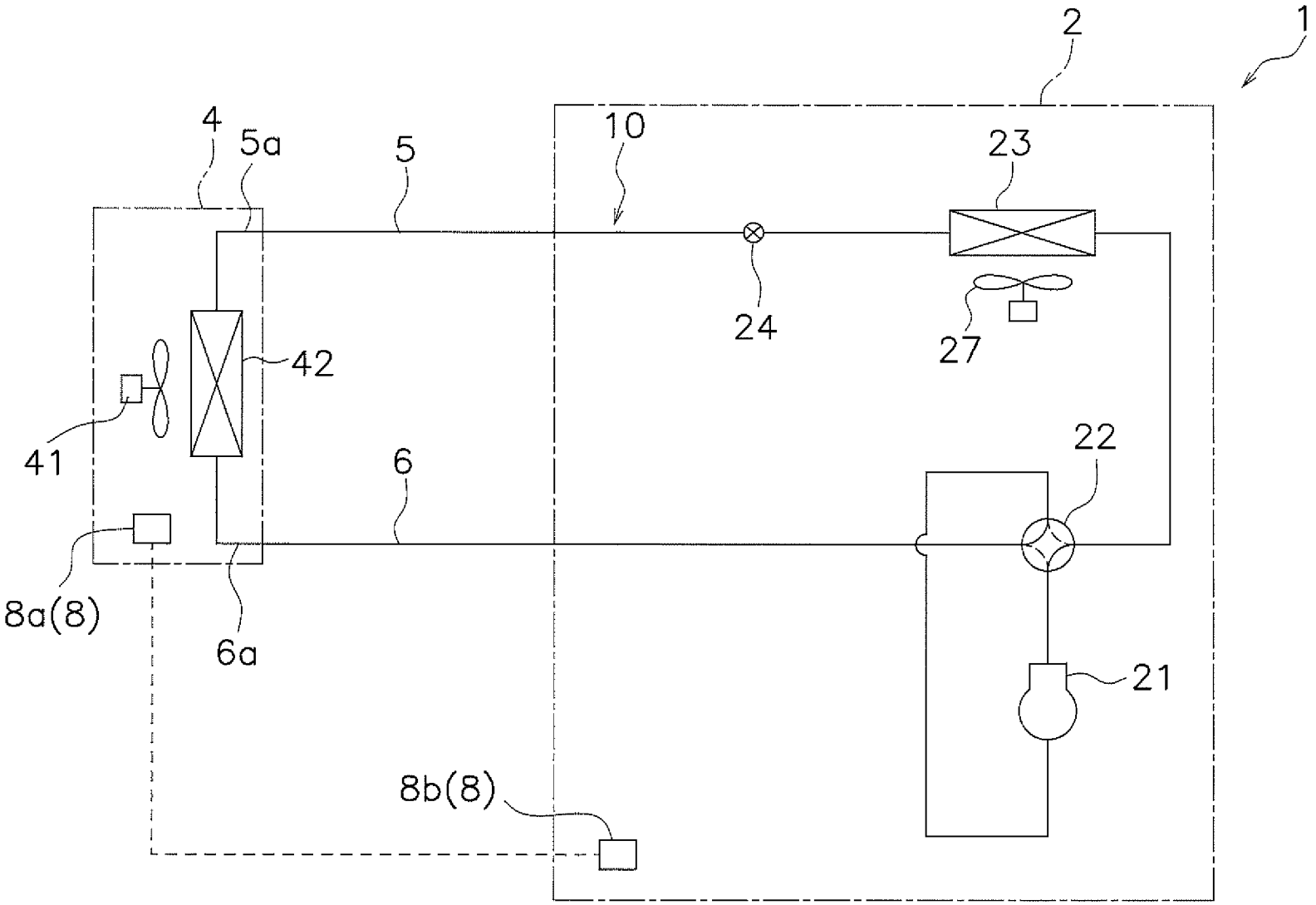
FIG. 1 is a block diagram of an air-conditioning apparatus 1 according to one or more embodiments of the present invention.

(1) Overview of Air-conditioning Apparatus (1-1) Basic Configuration of Air-conditioning Apparatus FIG. 1 is a block diagram of an air-conditioning apparatus 1 according to one or more embodiments of the present invention.

The air-conditioning apparatus 1 is an apparatus configured to perform cooling and heating of the interior of a building or the like by performing a vapor compression refrigeration cycle. The air-conditioning apparatus 1 is constituted by, mainly, an outdoor unit 2 and an indoor unit 4 that are connected to each other. The outdoor unit 2 and the indoor unit 4 are connected to each other via a liquid-refrigerant connection pipe 5 and a gas-refrigerant connection pipe 6. Various operations of the air-conditioning apparatus 1 are controlled by a control unit 8 that includes an indoor control unit 8*a* and an outdoor control unit 8. The control unit 8 controls various devices, valves, and the like on the basis of detection signals from various sensors.

While the air-conditioning apparatus 1 of a pair type in which the single outdoor unit 2 is connected to the single indoor unit 4 is illustrated, the air-conditioning apparatus 1 according to one or more embodiments may be an air-conditioning apparatus of a multi type in which a plurality of indoor units are connected to a single outdoor unit.

(1-2) Basic Action of Air-conditioning Apparatus

Next, basic action of the air-conditioning apparatus 1 will be described. The air-conditioning apparatus 1 is configured to perform a cooling operation and a heating operation as basic action. In addition, the air-conditioning apparatus 1 is also configured to perform a defrosting operation, an oil returning operation, and the like. These operations are controlled by the control unit 8.

(1-2-1) Cooling Operation

In the cooling operation, in a refrigerant circuit 10, a four-way switching valve 22 is set as indicated by solid lines in FIG. 1. In the refrigerant circuit 10, a low-pressure gas refrigerant is compressed at a compressor 21 and becomes a high-pressure gas refrigerant. The high-pressure gas refrigerant is sent to an outdoor heat exchanger 23 through the four-way switching valve 22. The high-pressure gas refrigerant that has been sent to the outdoor heat exchanger exchanges heat with outdoor air at the outdoor heat exchanger 23 and condenses. Consequently, the high-pressure gas refrigerant becomes a high-pressure liquid refrigerant. The high-pressure liquid refrigerant is decompressed at an expansion valve 24 and becomes a low-pressure refrigerant in a gas-liquid two-phase state. The low-pressure refrigerant in the gas-liquid two-phase state is sent to an indoor heat exchanger 42 through the liquid-refrigerant connection pipe 5 and a liquid-side connecting pipe 5*a*. Then, the refrigerant exchanges heat with air that is blown out from an indoor fan 41 in the indoor heat exchanger 42 and evaporates. Consequently, the refrigerant that has been sent to the indoor heat exchanger 42 becomes a low-pressure gas refrigerant. The low-pressure gas refrigerant is sent again to the compressor 21 through a gas-side connecting pipe 6*a*, the gas-refrigerant connection pipe 6, and the four-way switching valve 22.

(1-2-2) Heating Operation

In the heating operation, is the refrigerant circuit 10, the four-way switching valve 22 set as indicated by dashed lines in FIG. 1. In the refrigerant circuit 10, a low-pressure gas refrigerant is compressed at the compressor 21 and becomes a high-pressure gas refrigerant. The high-pressure gas refrigerant is sent to the indoor heat exchanger 42 through the four-way switching valve 22, the gas-refrigerant connection pipe 6, and the gas-side connecting pipe 6*a*. The high-pressure gas refrigerant that has been sent to the indoor heat exchanger 42 exchanges heat with air that is blown out from the indoor fan 41 and condenses. Consequently, the high-pressure gas refrigerant becomes a high-pressure liquid refrigerant. The high-pressure liquid refrigerant is sent to the expansion valve 24 through the liquid-side connecting pipe 5*a* and the liquid-refrigerant connection pipe 5. The high-pressure liquid refrigerant is decompressed at the expansion valve 24 and becomes a low-pressure refrigerant in a gas-liquid two-phase state. The low-pressure refrigerant in the gas-liquid two-phase state is sent to the outdoor heat exchanger 23. Then the refrigerant exchanges heat with outdoor air at the outdoor heat exchanger 23 and evaporates. Consequently, the refrigerant that has been sent to the outdoor heat exchanger 23 becomes a low-pressure gas refrigerant. The low-pressure gas refrigerant is sent again to the compressor 21 through the four-way switching valve 22.

(2) Configuration of Indoor Unit

In addition to the provision of the aforementioned basic configuration, the air-conditioning apparatus according to one or more embodiments includes the following configuration of the indoor unit.

In one or more embodiments, the term "indoor" is used to intend distinction from other rooms and used to intend to include, for example, a space on the rear side of an indoor ceiling in addition to an indoor space partitioned by wall surfaces.

(2-1) Basic Configuration of Indoor Unit

The indoor unit 4 is installed indoor and constitutes a portion of the refrigerant circuit 10. The indoor unit 4 includes, mainly, the indoor fan 41, the indoor heat exchanger 42, and the indoor control unit 8*a*.

The indoor fan 41 takes in indoor air to an inner portion of the indoor unit 4. Consequently, it is possible to cause a heat exchange between the indoor air and the refrigerant in the indoor heat exchanger 42. The indoor fan 41 supplies, as supply air, the indoor air with which heat is exchanged at the indoor heat exchanger 42. As the indoor fan 41, a centrifugal fan, a multi-blade fan, or the like is used. The indoor fan 41 is driven by an indoor-fan motor whose number of revolutions is controllable.

The indoor heat exchanger 42 functions as an 'evaporator' for a refrigerant during the cooling operation and cools indoor air, and functions as a 'condenser' (radiator) for a refrigerant during heating operation and heats indoor air. The indoor heat exchanger 42 is connected to the liquid-refrigerant connection pipe 5 and the gas-refrigerant connection pipe 6. The indoor heat exchanger 42 will be further described later in detail.

The indoor control unit 8*a* is configured to control action of each portion that constitutes the indoor unit 4. Specifically, the indoor control unit 8*a* includes a microcomputer, a memory, and the like and controls action of the indoor unit 4 on the basis of detection values and the like of various sensors and the like disposed in the indoor unit 4. The indoor control unit 8*a* exchanges control signals with a remote controller (not illustrated) configured to individually operate the indoor unit 4 and exchanges control signals with the outdoor control unit 8*b* via a transmission line.

In addition, the indoor unit 4 includes various sensors. Consequently, a temperature of the refrigerant in the indoor heat exchanger 42, a temperature of the indoor air that is taken in to the inner portion of the indoor unit 4, and the like are detected.

(2-2) Indoor Unit of Ceiling-Embedded Type

Figure 2:
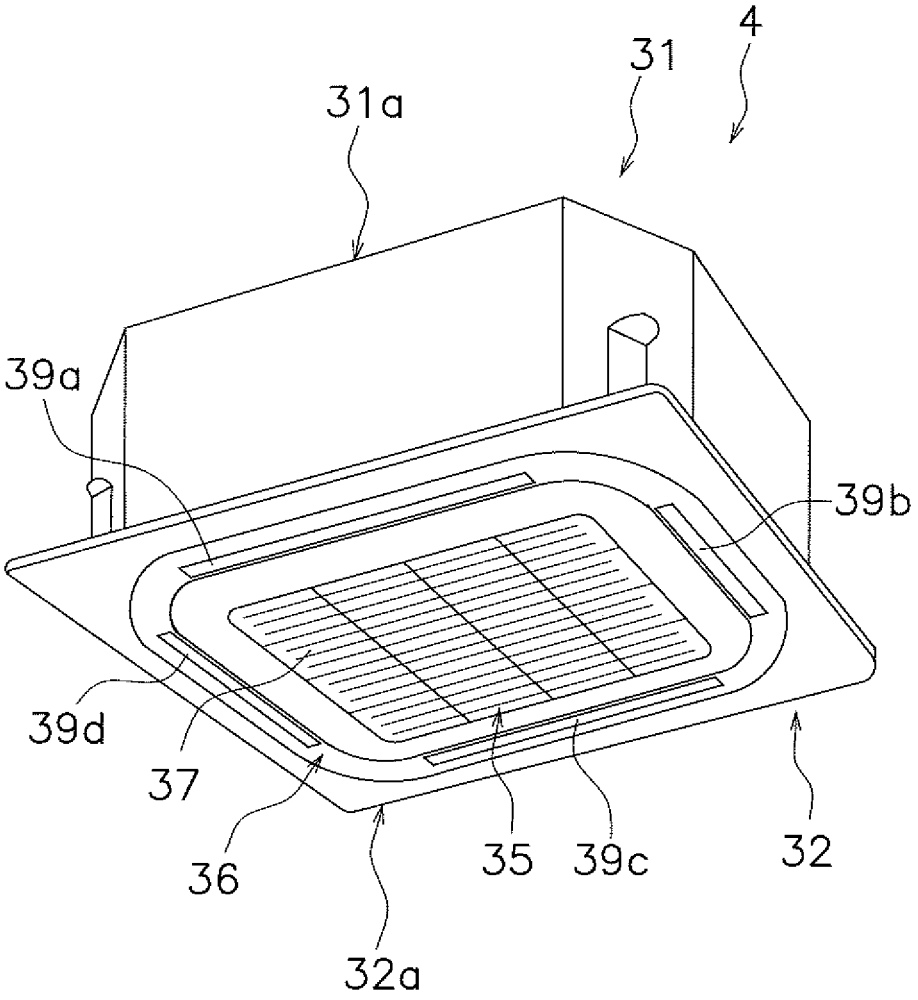
FIG. 2 is a perspective view of an external appearance of an indoor unit 4 of a ceiling-installation type air-conditioning apparatus according to one or more embodiments.
Figure 3:
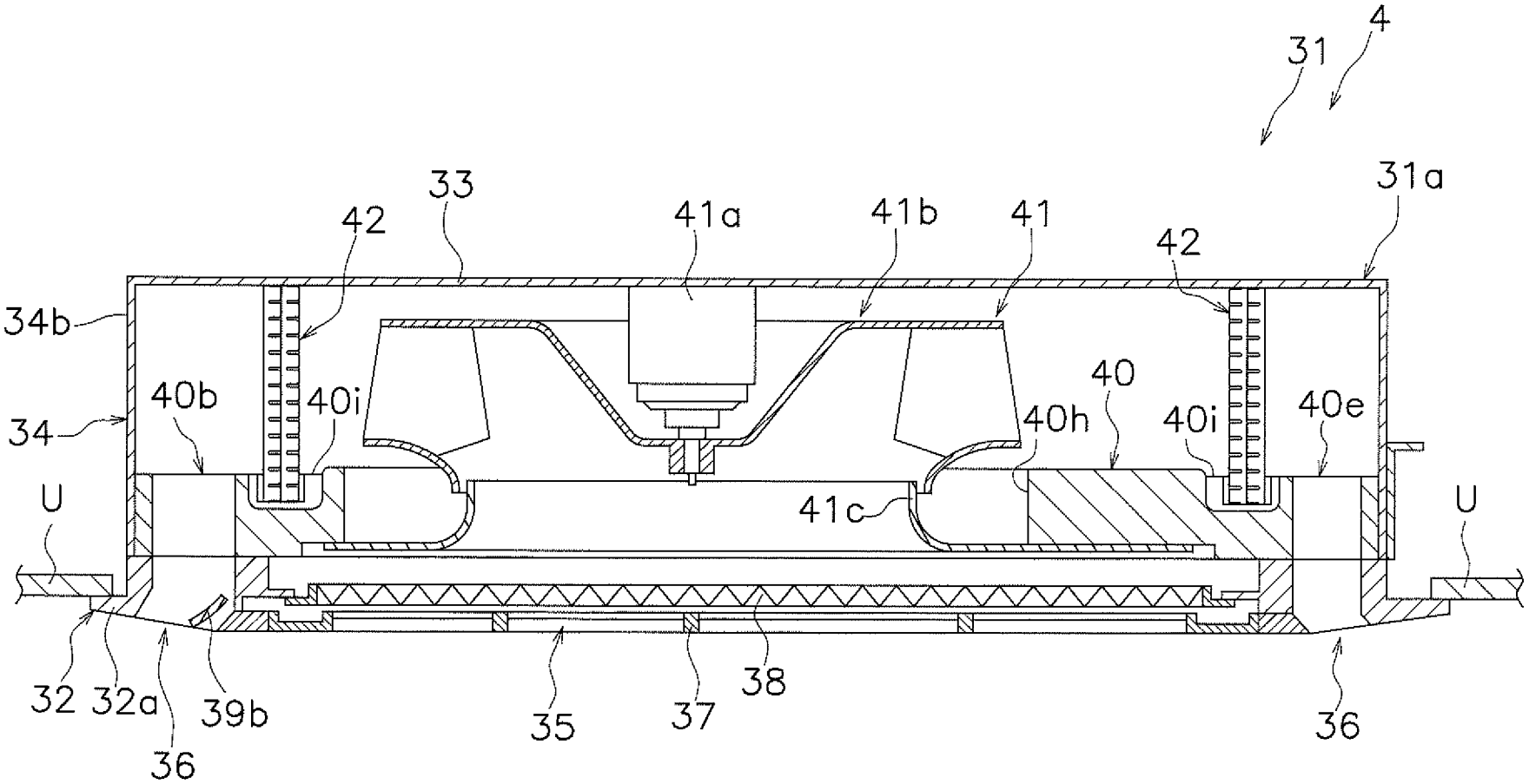
FIG. 3 is a schematic sectional view of the indoor unit 4 of the ceiling-installation type air-conditioning apparatus according to one or more embodiments.
Figure 4:
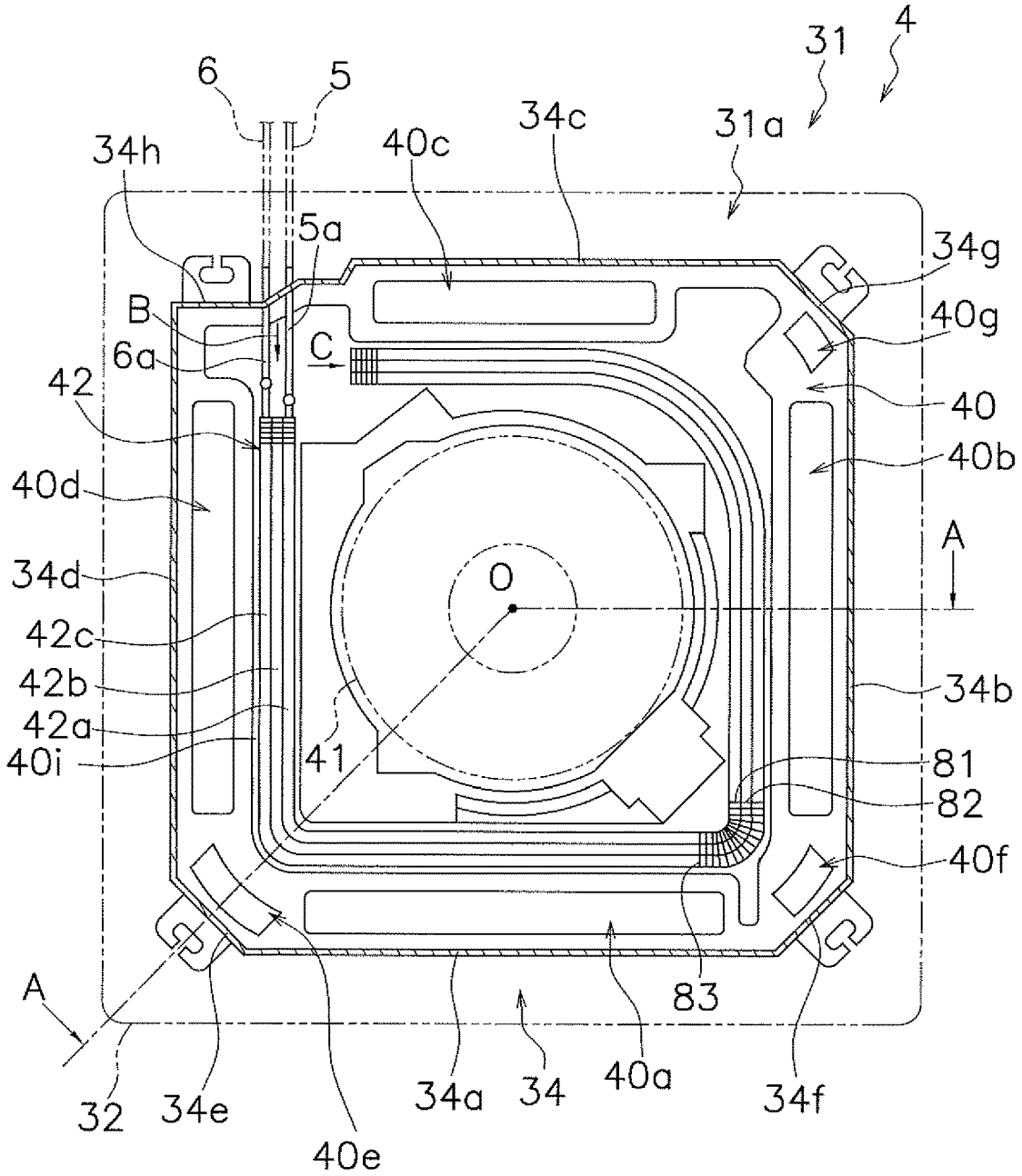
FIG. 4 is a schematic plan view illustrating a state in which a top panel 33 of the indoor unit 4 of a ceiling-embedded type according to one or more embodiments is removed.

The indoor unit 4 according to one or more embodiments may employ a configuration of a type known as a ceiling-embedded type. FIG. 2 is a perspective view of an external appearance of the indoor unit 4 of the ceiling-embedded type according to one or more embodiments. FIG. 3 is a schematic sectional view of the indoor unit 4 of the ceiling-embedded type according to one or more embodiments. FIG. 3 is a cross section along the line A-O-A in FIG. 4, which will be described later. FIG. 4 is a schematic plan view illustrating the indoor unit 4 of the ceiling-embedded type according to one or more embodiments in a state in which a top panel 33 of the indoor unit 4 is removed.

The indoor unit of the ceiling-embedded type houses the indoor fan 41 and the indoor heat exchanger 42 in a casing 31. A drain pan 40 is mounted on a lower portion of the casing 31.

(2-2-1) Casing

The casing 31 houses various components in an inner portion thereof. The casing 31 includes, mainly, a casing body 31*a* and a decorative panel 32 disposed on the lower side of the casing body 31*a*. As illustrated in FIG. 3, the casing body 31*a* is disposed at a ceiling U in a room into which conditioned air is supplied. The ceiling U has an opening, and the casing body 31*a* is inserted into the opening of the ceiling U. The decorative panel 32 is disposed to be fitted into the opening of the ceiling U.

As illustrated in FIG. 3 and FIG. 4, the casing body 31*a* in plan view is a box-shaped body that opens at a lower surface thereof having a substantially octagonal shape formed by long sides and short sides that are alternately connected together. Specifically, the casing body 31*a* includes the top panel 33 having a substantially octagonal shape formed by long sides and short sides that are alternately arranged in a continuous manner, and a side plate 34 extending downward from a peripheral edge portion of the top panel 33. The side plate 34 is constituted by side plates 34*a*, 34*b*, 34*c*, and 34*d* corresponding to the long sides of the top panel 33 and side plates 34*e*, 34*f*, 34*g*, and 34*h* corresponding to the short sides of the top panel 33. The side plate 34*h* includes a portion through which the liquid-side connecting pipe 5*a* and the gas-side connecting pipe 6*a* pass and is configured to connect the refrigerant connection pipes 5 and 6 to the indoor heat exchanger 42.

As illustrated in FIGS. 2 to 4, the decorative panel 32 is a plate-shaped body that has a substantially quadrangular shape in plan view and constituted by, mainly, a panel body 32*a* fixed to a lower end portion of the casing body 31*a*. The panel body 32*a* includes, at a substantially center portion thereof, an intake port 35 through which air in an air-conditioned room is taken in and a blow-out port 36 formed to surround the periphery of the intake port 35 in plan view and through which air is blown out into the air-conditioned room. The intake port 35 is an opening that has a substantially quadrangular shape. An intake grille 37 and a filter 38 that is configured to remove dust in the air that has been taken in from the intake port 35 are disposed at the intake port 35. The blow-out port 36 is an opening that has a substantially quadrangular ring shape. Horizontal flaps 39*a*, 39*b*, 39*c*, and 39*d* configured to adjust a direction of air that is blown out into an air-conditioned room are disposed at the blow-out port 36 so as to correspond to the sides of the quadrangular shape of the panel body 32*a*.

(2-2-2) Drain Pan

The drain pan 40 is a member configured to receive drain water that is generated in the indoor heat exchanger 42 as a result of a water content in air being condensed. The drain pan 40 is mounted on a lower portion of the casing body 31*a*. The drain pan 40 has blow-out holes 40*a*, 40*b*, 40*c*, 40*d*, 40*e*, 40*f*, and 40*g*, an intake hole 40*h*, and a drain-water receiving groove 40*i*. The blow-out holes 40*a* to 40*g* are formed to communicate with the blow-out port 36 of the decorative panel 32. The intake hole 40*h* is formed to communicate with the intake port 35 of the decorative panel 32. The drain-water receiving groove 40*i* is formed on the lower side of the indoor heat exchanger 42. A bell mouth 41*c* configured to guide air that is taken in from the intake port 35 to an impeller 41*b* of the indoor fan is disposed at the intake hole 40*h* of the drain pan 40.

(2-2-3) Indoor Fan

The indoor fan 41 is constituted by a centrifugal fan. The indoor fan 41 is configured to take in indoor air to an inner portion of the casing body 31*a* through the intake port 35 of the decorative panel 32 and blow out the indoor air from the inner portion of the casing body 31*a* through the blow-out port 36 of the decorative panel 32. Specifically, the indoor fan 41 includes a fan motor 41*a* disposed at a center portion of the top panel 33 of the casing body 31*a*, and the impeller 41*b* that is coupled to the fan motor 41*a* and driven to rotate. The impeller 41*b* includes a turbo blade. The impeller 41*b* takes in air from bellow to an inner portion of the impeller 41*b* and blows out the taken-in air toward the outer peripheral side of the impeller 41*b* in plan view.

(2-2-4) Indoor Heat Exchanger

The indoor heat exchanger 42 is disposed in the casing 31 by being bent to surround the periphery of the indoor fan 41 in plan view. The liquid side of the indoor heat exchanger 42 is connected to the liquid-refrigerant connection pipe 5 via the liquid-side connecting pipe 5*a*. The gas side of the indoor heat exchanger 42 is connected to the gas-refrigerant connection pipe 6 via the gas-side connecting pipe 6*a*. The indoor heat exchanger 42 functions as a refrigerant evaporator during the cooling operation and as a refrigerant condenser during the heating operation. Consequently, the indoor heat exchanger 42 performs a heat exchange between the air that has been blown out from the indoor fan 41 and the refrigerant, cools the air during the cooling operation, and heats the air during the heating operation. A specific structure and features of the indoor heat exchanger 42 will be described below.

Figure 5:
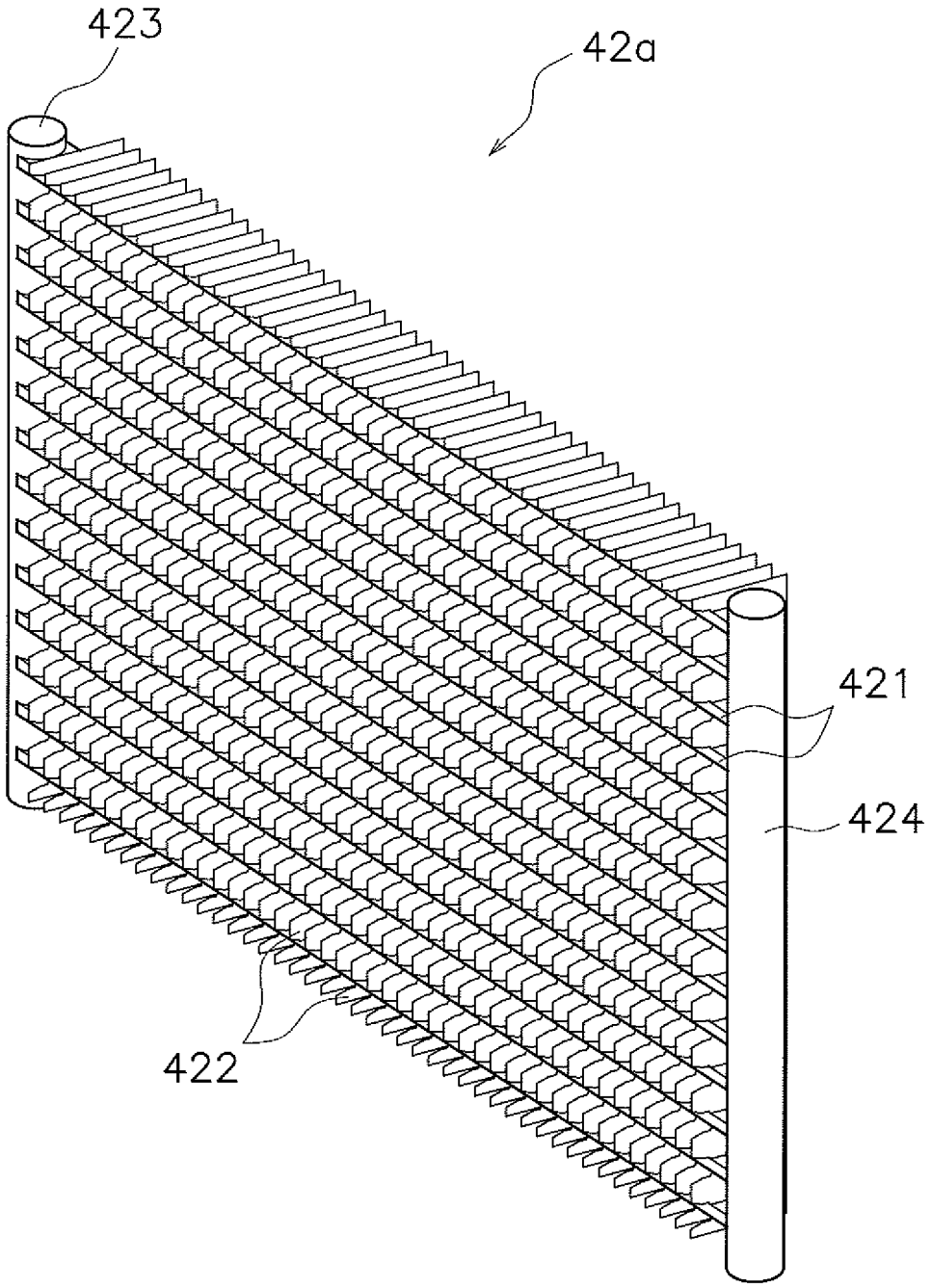
FIG. 5 is a schematic perspective view of a heat exchanger 42*a* used in a heat exchanger unit 42 according to one or more embodiments.
Figure 6:
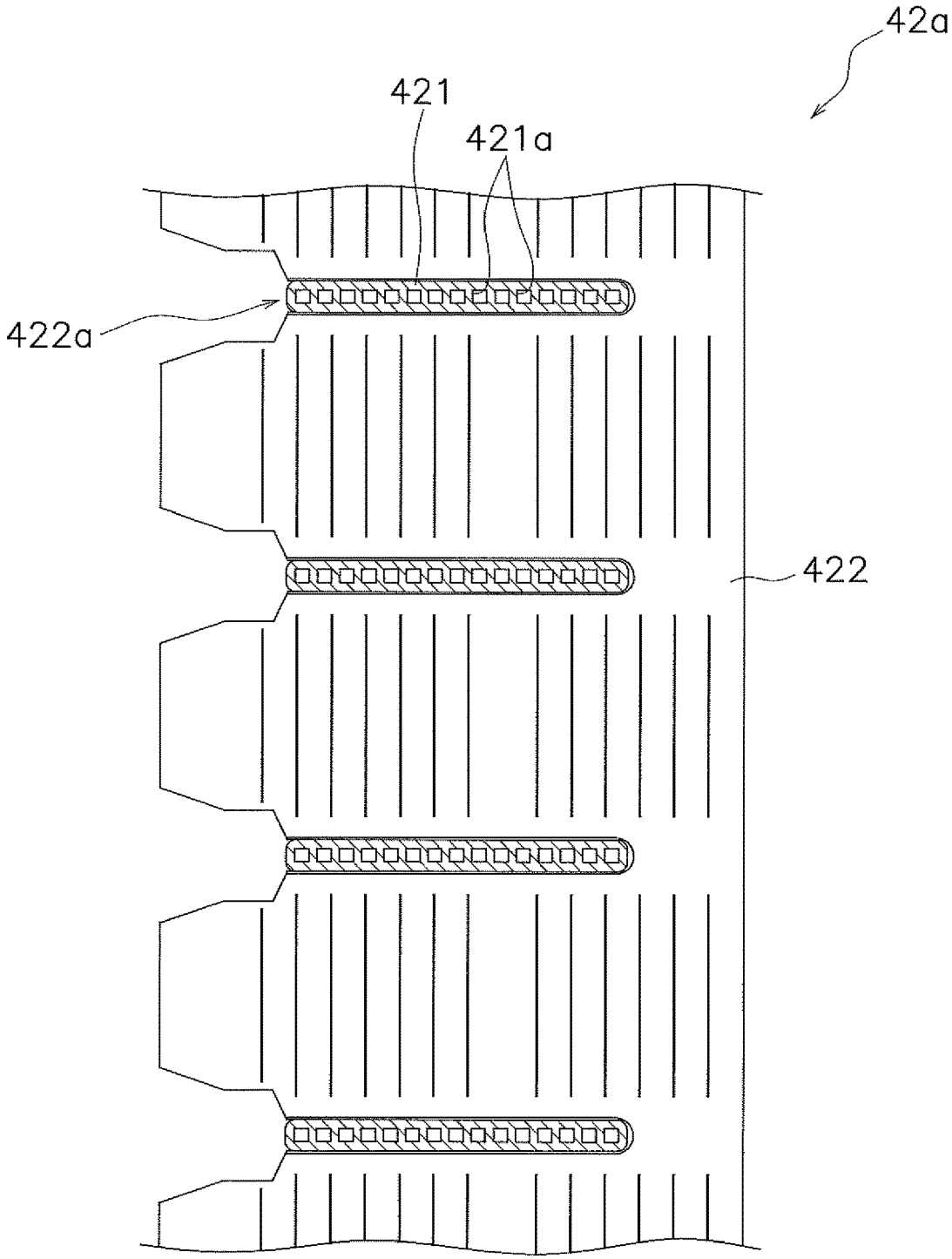
FIG. 6 is a schematic longitudinal sectional view of the heat exchanger used in the heat exchanger unit 42 according to one or more embodiments.

(3) Specific Form of Indoor Heat Exchanger (3-1) Basic Configuration of Heat Exchanger FIG. 5 is a schematic perspective view of a heat exchanger 42*a* used in the indoor heat exchanger 42. FIG. 6 is a schematic longitudinal sectional view of a heat exchanger used in the heat exchanger 42*a*. In FIG. 5, illustration of refrigerant pipes, communication pipes, and the like is omitted.

The heat exchanger 42*a* is an insertion-fin type stacked heat exchanger that includes, mainly, heat transfer tubes 421 constituted by flat multi-hole pipes, a large number of fins 422, and two headers 423 and 424.

The heat transfer tubes 421 are realized by the flat multi-hole pipes. The heat transfer tubes 421 are connected, at two ends thereof, to each of the headers 423 and 424. The heat transfer tubes 421 are arranged in a plurality of tiers with an interval therebetween in a state in which flat surface portions thereof are directed upward or the downward. Specifically, each of the heat transfer tubes 421 includes upper and lower flat surface portions that serve as heat transfer surfaces, and a large number of small refrigerant flow paths 421*a* that allow a refrigerant to flow therethrough. The refrigerant flow paths 421*a* that have small flow-path holes having an inner diameter of 1 mm or less and having a circular shape or a polygonal shape that has a cross-sectional area equivalent to that of the circular shape is used. The heat transfer tubes 421 are formed of aluminum or an aluminum alloy.

Figure 7:
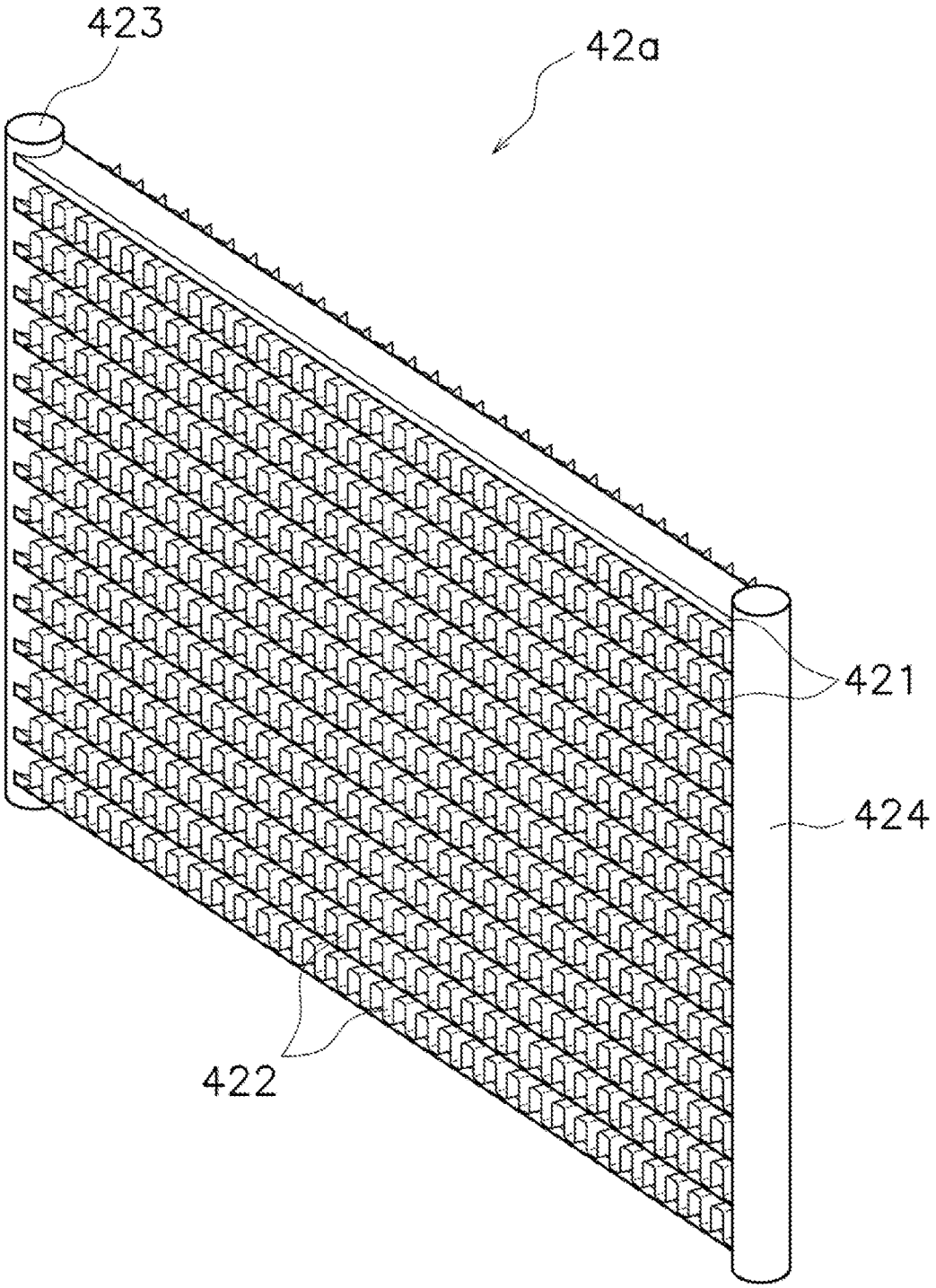
FIG. 7 is a schematic perspective view illustrating another example of the heat exchanger 42*a* used in the heat exchanger unit 42 according to one or more embodiments.

The fins 422 are inserted with respect to the plurality of tiers of the heat transfer tubes 421 arranged between the headers 423 and 424. Specifically, the fins 422 each have a plurality of cutouts 422*a* horizontally extending in an elongated shape. The shape of each cutout 422*a* substantially coincides with the outer shape of the cross section of each heat transfer tube 421. It is thus possible to insert the fins 422 so as to be in contact with the heat transfer tubes 421 as a result of the cutouts 422*a* and the heat transfer tubes 421 engaging with each other. The fins 422 are formed of aluminum or an aluminum alloy. The fins 422 may employ various shapes and may have, for example, a wavy shape illustrated in FIG. 7.

The two headers 423 and 424 each have a function of supporting the heat transfer tubes 421, a function of guiding a refrigerant to the refrigerant flow paths 421*a* of the heat transfer tubes 421, and a function of collecting the refrigerant that has flowed out from the refrigerant flow paths 421*a*.

(3-2) Configuration of Heat Exchanger Unit

The indoor heat exchanger 42 according to one or more embodiments is constituted by a heat exchanger unit in which a plurality of the heat exchangers 42*a* that has the aforementioned configuration are combined together. In the following description, the heat exchanger unit as the indoor heat exchanger will be described with the 'reference sign 42' for convenience. The heat exchanger unit 42 includes at least a first heat exchanger 52 and a second heat exchanger 62. The first heat exchanger 52 and the second heat exchanger 62 have the same configuration as that of the aforementioned heat exchanger 42*a* and, however, will be described with the reference sign thereof replaced for convenience. In the following description, the first digit of the reference sign is '4' to describe the configuration of the entirety of the heat exchanger unit, the first digit of the reference sign is replaced with '5' to describe the first heat exchanger 52, and the first digit of the reference sign is replaced with '6' to describe the second heat exchanger 62. For example, the heat transfer tubes of the first heat exchanger 52 and the heat transfer tubes of the second heat exchanger 62 have the same configuration and, however, will be described with the 'reference sign 521' and the 'reference sign 621', respectively, instead of the reference sign 421.

Figure 8:
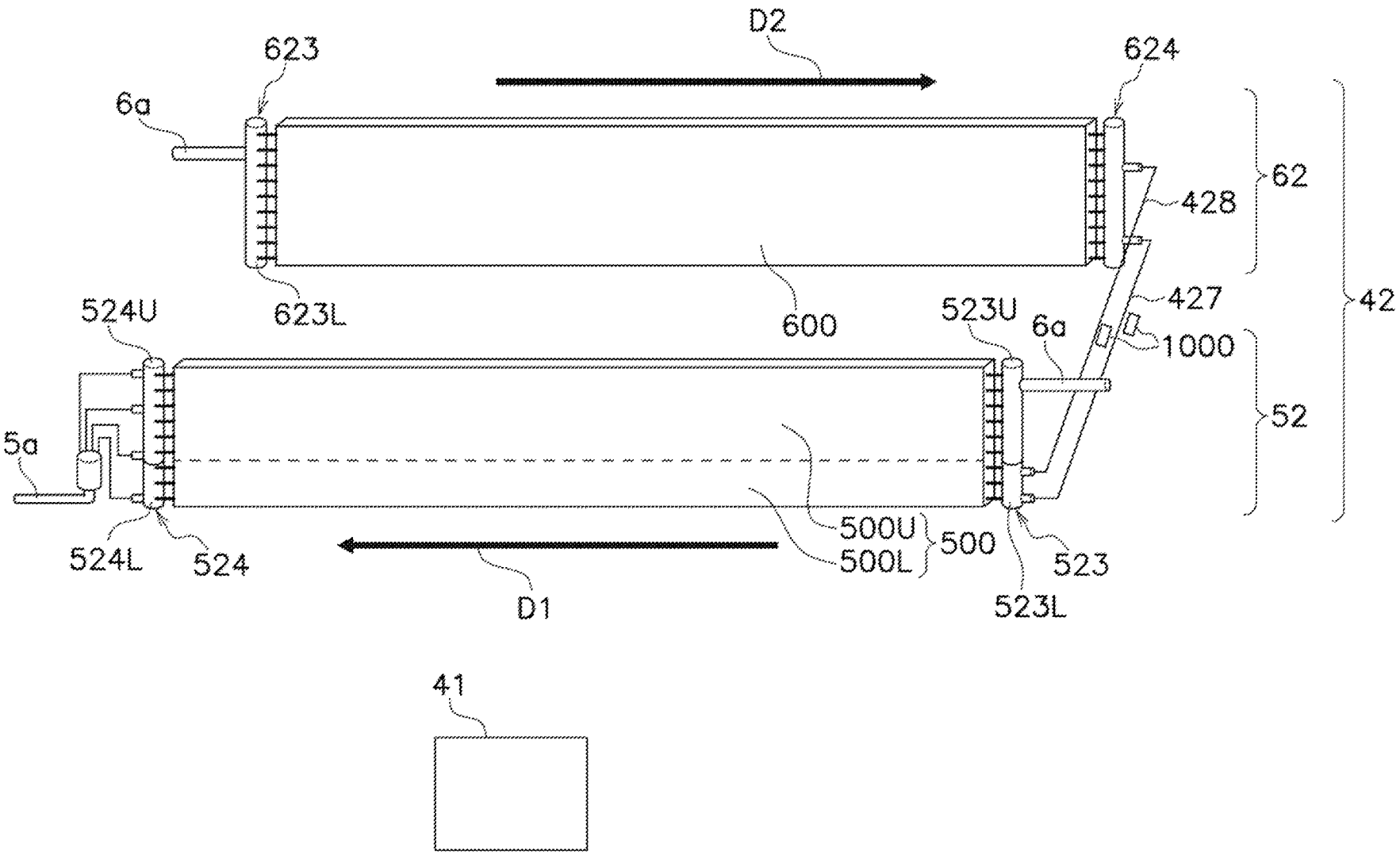
FIG. 8 is a schematic view illustrating a configuration of the heat exchanger unit 42 according to one or more embodiments.
Figure 9:
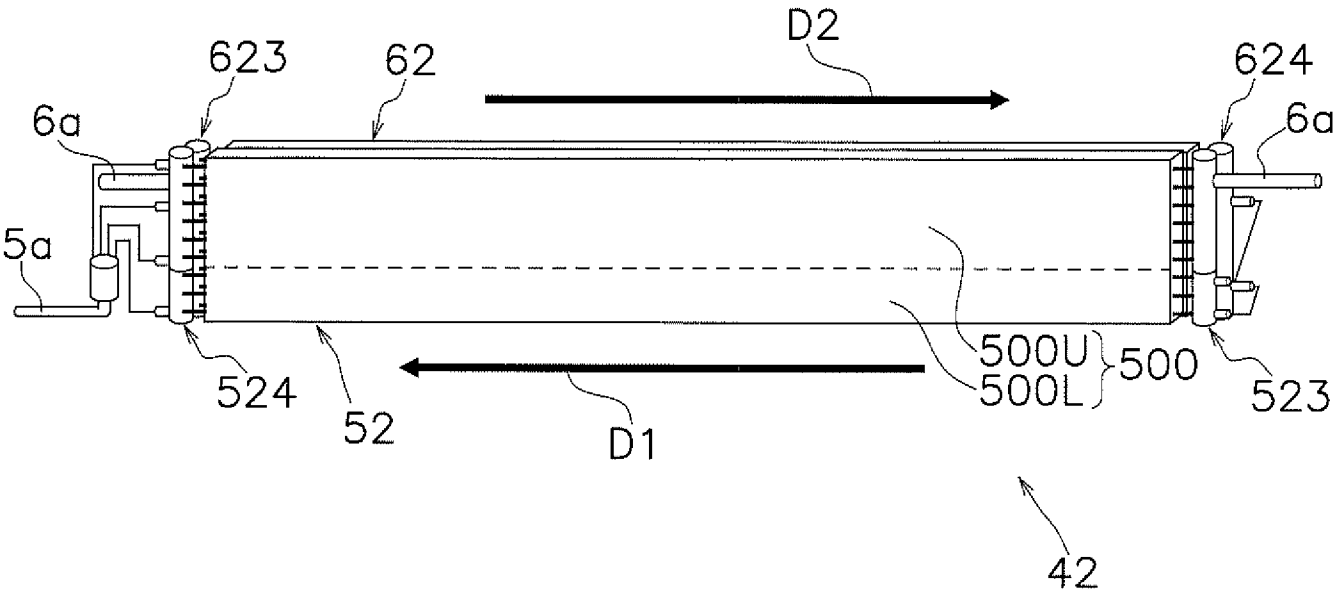
FIG. 9 is a schematic view illustrating a configuration of the heat exchanger unit 42 according to one or more embodiments.

FIG. 8 is a schematic view illustrating a configuration of the heat exchanger unit 42 according to one or more embodiments. The heat exchanger unit 42 includes the first heat exchanger 52 disposed on the air upstream side of an air flow generated by the indoor fan 41 (fan) and a second heat exchanger 62 disposed on the air downstream side of the air flow generated by the indoor fan 41 so as to be arranged in parallel with the first heat exchanger 52. A first direction D1 of a refrigerant flow from an upper-side first header 523U toward an upper-side second header 524U of the first heat exchanger 52 and a second direction D2 of a refrigerant flow from a third header 623 toward a fourth header 624 of the second heat exchanger 62 are opposite to each other. For convenience of description, the first heat exchanger 52 and the second heat exchanger 62 are illustrated so as to be separated from each other in FIG. 8; however, these heat exchangers should be disposed so as to be sufficiently close to each other to function as an integral body (refer to FIG. 9).

The first heat exchanger 52 includes a first header 523 and a second header 524, and a first flat pipe group 500 constituted by a plurality of flat multi-hole pipes (heat transfer tubes) connected to each of the first header 523 and the second header 524. At the first flat pipe group 500, the plurality of flat multi-hole pipes are arranged in an up-down direction. In the first flat pipe group 500, one or more of the flat multi-hole pipes on the upper side form an upper-side first heat exchanging region 500U, and one or more of the flat multi-hole pipes on the lower side form a lower-side first heat exchanging region 500L. The area of the upper-side first heat exchanging region 500U is configured to be larger than the area of the lower-side first heat exchanging region 500L.

Figure 10:
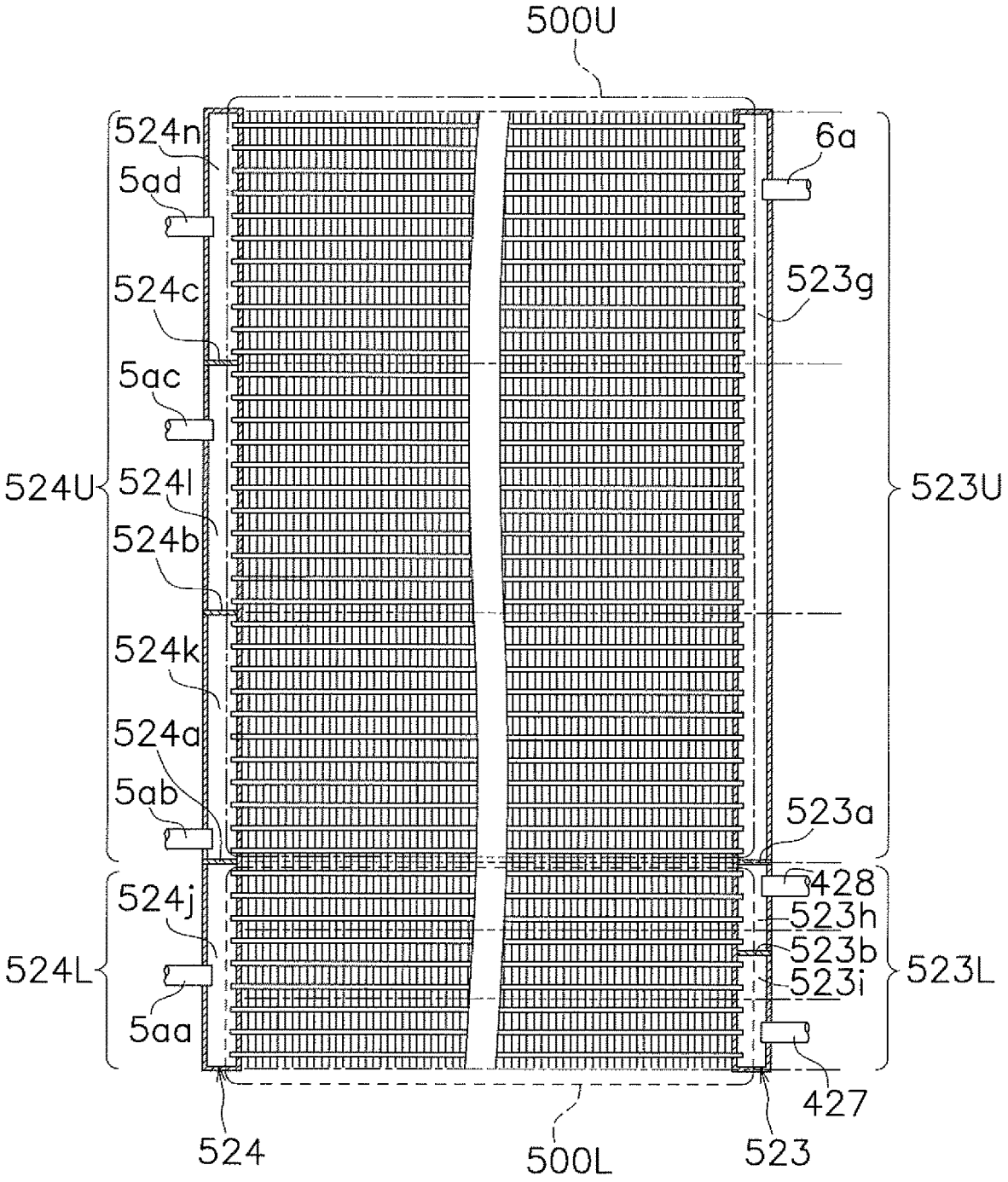
FIG. 10 is a schematic view illustrating a configuration of a first heat exchanger 52 according to one or more embodiments.

As illustrated in FIG. 10, the first header 523 includes the upper-side first header 523U connected to the upper-side first heat exchanging region 500U, and a lower-side first header 523L connected to the lower-side first heat exchanging region 500L. Specifically, an inner space of the first header 523 is partitioned in the up-down direction (into three, here) by partition plates 523*a* and 523*b*. A space 523*g* on the upper side of the partition plate 523*a* is connected to the upper-side first heat exchanging region 500U, and spaces 523*h* and 523*i* on the lower side of the partition plate 523*a* are connected to the lower-side first heat exchanging region 500L. The gas-side connecting pipe 6*a* is connected to the upper-side first header 523U. At the lower-side first header 523L, a coupling pipe 427 is connected to the space 523*i* on the lower side of the partition plate 523*b*, and a coupling pipe 428 is connected to the space 523*h* on the upper side of the partition plate 523*b*.

As illustrated in FIG. 10, the second header 524 includes the upper-side second header 524U connected to the upper-side first heat exchanging region 500U, and a lower-side second header 524L connected to the lower-side first heat exchanging region 500L. Specifically, an inner space of the second header 524 is partitioned in the up-down direction (into four, here) by partition plates 524*a*, 524*b*, and 524*c*. Spaces 524*k*, 524*l*, and 524*m* on the upper side of the partition plate 524*a* are connected to the upper-side first heat exchanging region 500U, and a space 524*j* on the lower side of the partition plate 524*a* is connected to the lower-side first heat exchanging region 500L. Pipes 5*aa*, 5*ab*, 5*ac*, and 5*ad* communicating with the liquid-side connecting pipe 5*a* are individually connected to the upper-side second header 524U and the lower-side second header 524L.

The second heat exchanger 62 includes the third header 623 and the fourth header 624, and a second flat pipe group 600 constituted by a plurality of flat multi-hole pipes (heat transfer tubes) connected to each of the third header 623 and the fourth header 624. At the second flat pipe group 600, the plurality of flat multi-hole pipes are arranged in the up-down direction.

Figure 11:
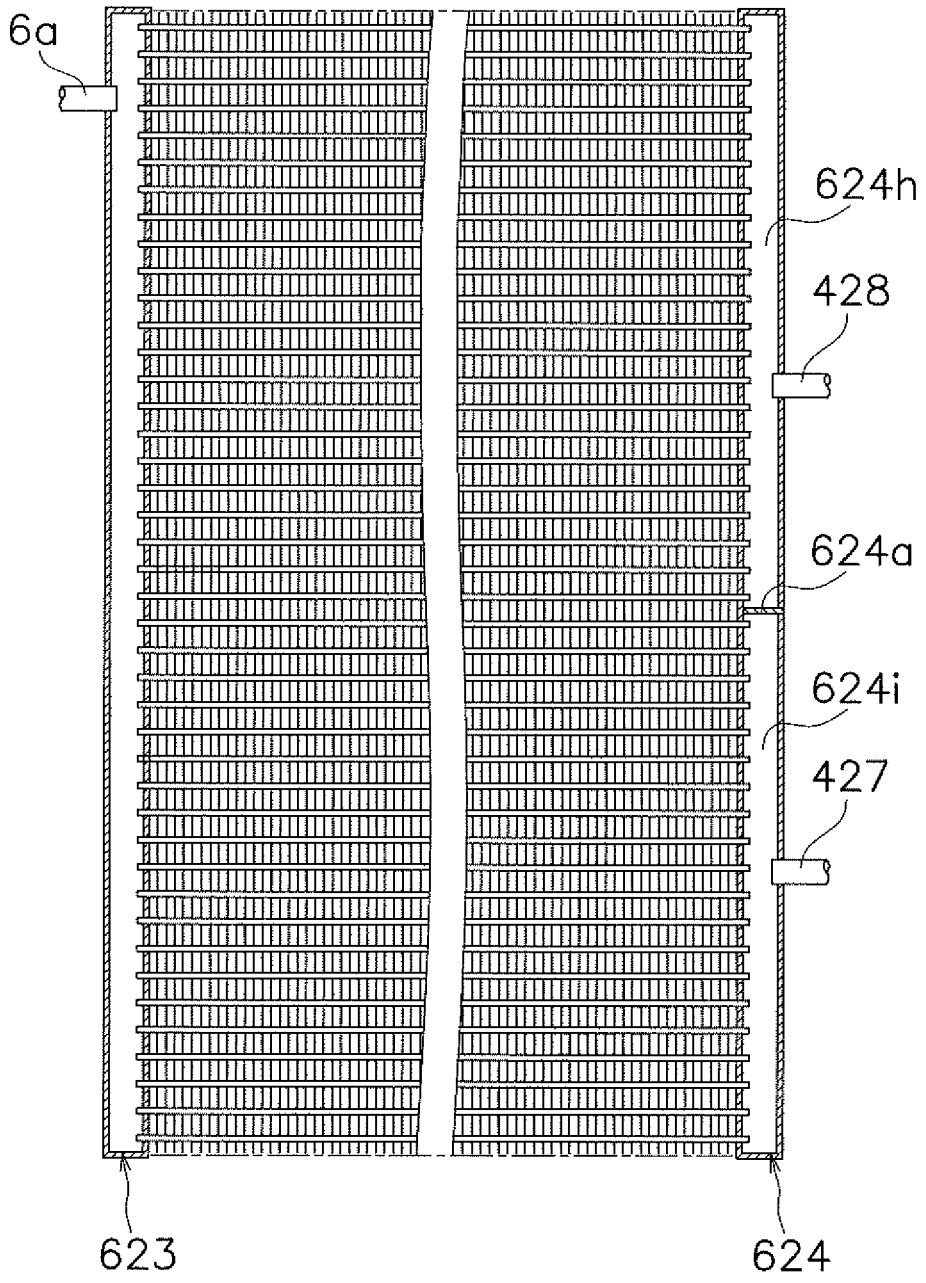
FIG. 11 is a schematic view illustrating a configuration of a second heat exchanger 62 according to one or more embodiments.

As illustrated in FIG. 11, the third header 623 is connected to the gas-side connecting pipe (gas-refrigerant pipe) 6*a* that allows a gaseous refrigerant to flow therethrough.

As illustrated in FIG. 11, the fourth header 624 is connected to the first header 523 via the coupling pipes 427 and 428. Consequently, a refrigerant that flows in from the third header 623 flows out to the lower-side first header 523L. An inner space of the fourth header 624 is partitioned in the up-down direction (into two, here) by a partition plate 624*a*. The coupling pipe 428 is connected to a space 624*h* on the upper side of the partition plate 624*a*, and the coupling pipe 427 is connected to a space 624*i* on the lower side of the partition plate 624*a*.

The coupling pipes 427 and 428 couple the fourth header 624 and the lower-side first header 523L to each other. A temperature measurement device (temperature sensor) 1000, configured to measure a temperature of a refrigerant, is installed at each of the coupling pipes 427 and 428.

(3-3) Features of Heat Exchanger Unit (3-3-1)

Figure 12:
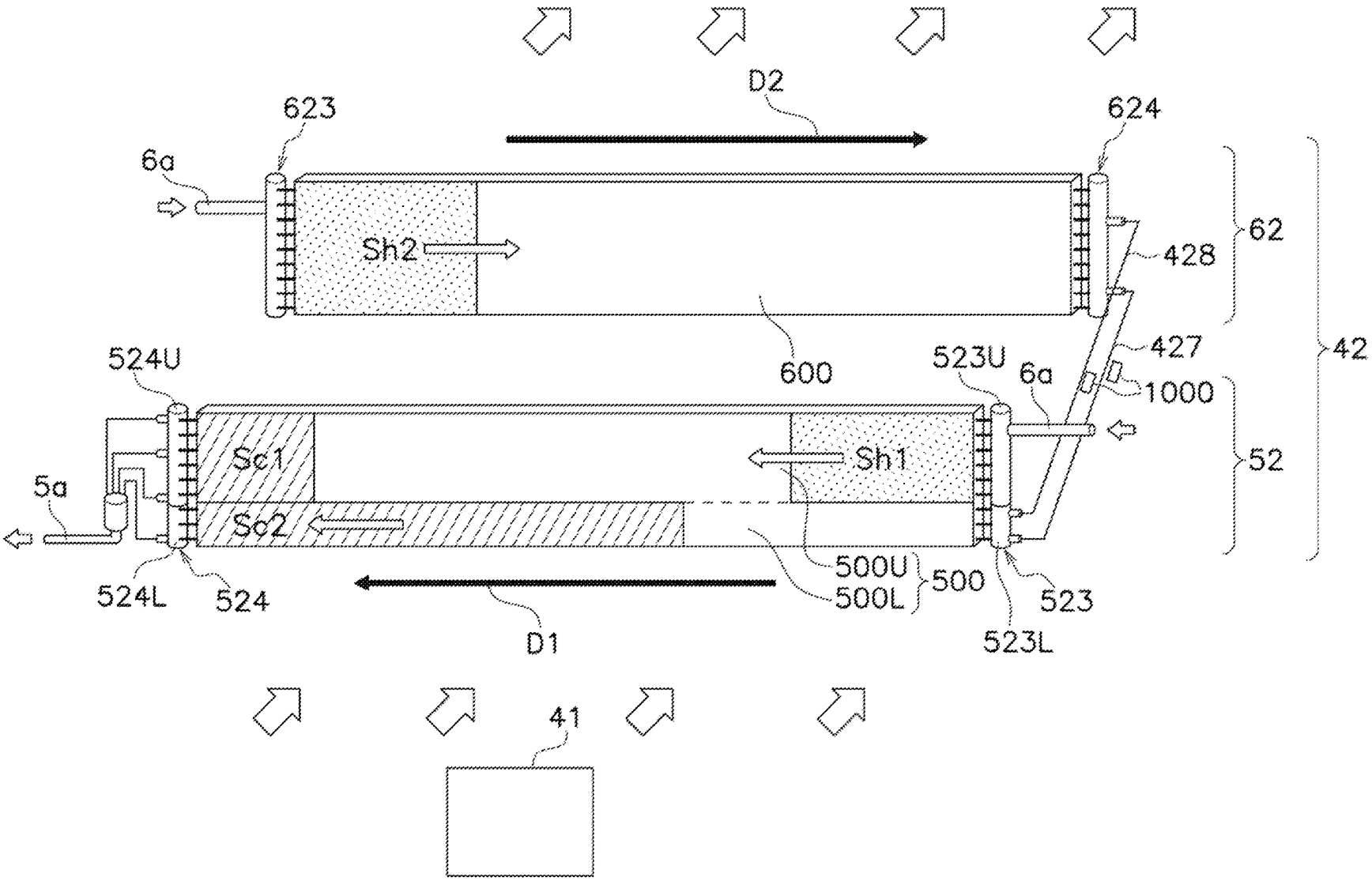
FIG. 12 is a view for describing an internal state when the heat exchanger unit 42 according to one or more embodiments is used as a condenser.
Figure 13:
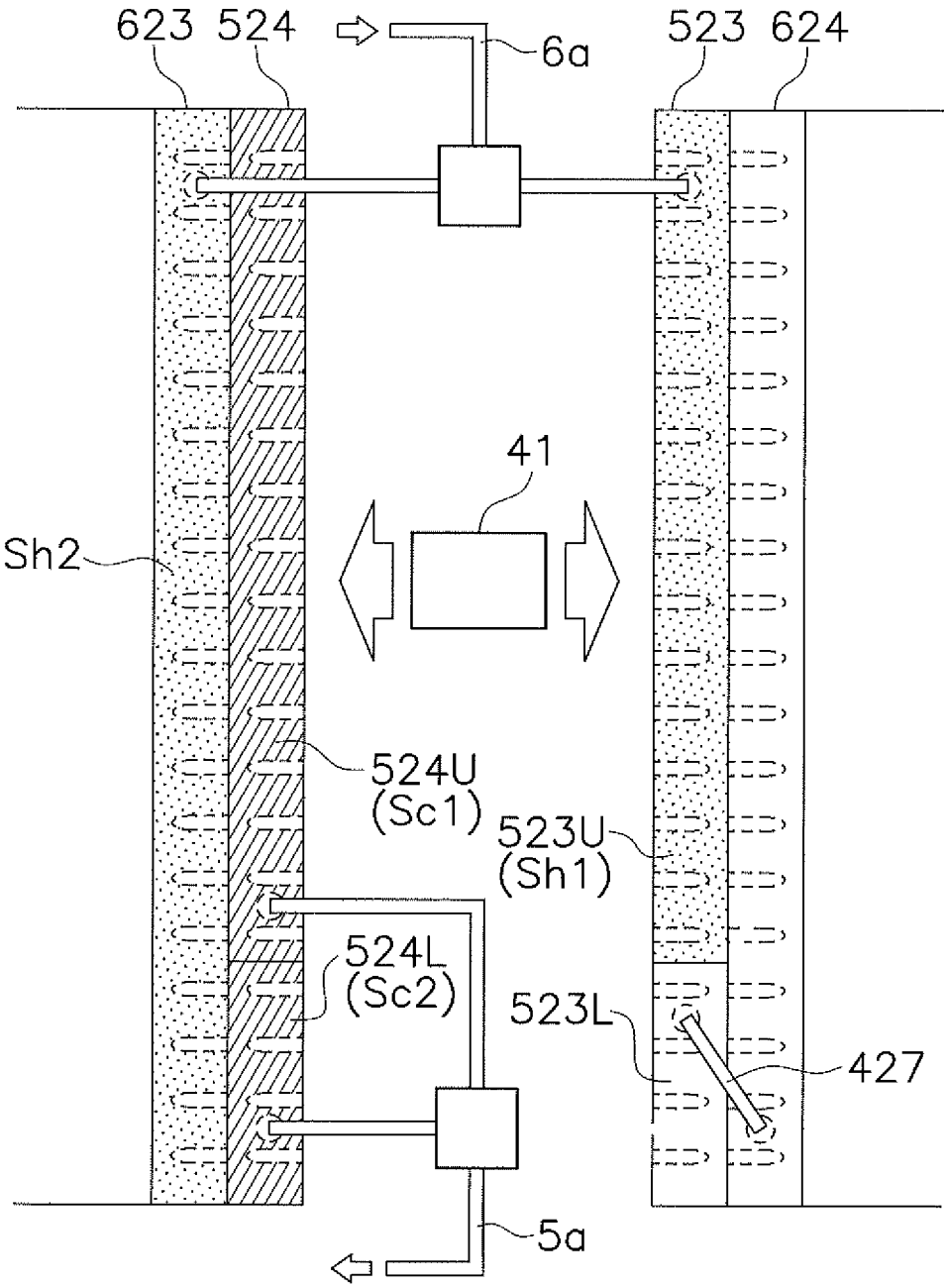
FIG. 13 is a view for describing an internal state when the heat exchanger unit 42 according to one or more embodiments is used as a condenser.

When the aforementioned heat exchanger unit 42 is used as a condenser, the internal state of the heat exchanging region is as illustrated in FIGS. 12 and 13. FIG. 13 is a view illustrating a state of the heat exchanging region when the heat exchanger unit 42 is bent and viewed along a cross section of a connection portion of the heat exchanger unit 42 connected to the gas-side connecting pipe 6*a* (gas-refrigerant pipe) and the liquid-side connecting pipe 5*a* (liquid-refrigerant pipe). In other words, FIG. 13 is a schematic view illustrating a state of the heat exchanging region when the heat exchanger unit 42 is viewed from the side of the side plate 34*h* of the casing body 31*a*. In FIGS. 12 and 13, hatching of regions Sc1 and Sc2 indicates the subcooling region at which a refrigerant is subcooled, and hatching of regions Sh1 and Sh2 indicates the superheating region at which a refrigerant is superheated.

In short, in the heat exchanger unit 42 according to one or more embodiments, the first heat exchanger 52 is disposed on the air upstream side, the second heat exchanger 62 is disposed on the air downstream side, and the fourth header 624 on the air downstream side causes a refrigerant to flow out to the first header 523 on the air upstream side; thus, when the heat exchanger unit 42 is used as a condenser, a refrigerant that flows in the second heat exchanger 62 on the air downstream side can be subcooled at the first heat exchanger 52 on the air upstream side. Consequently, when the heat exchanger unit 42 is used as a condenser, it is possible to increase a temperature difference between the refrigerant and air with which heat is exchanged at the first heat exchanger 52 on the air upstream side, and it is thus possible to increase the amount of the refrigerant that is to be subcooled. As a result, it is possible to improve the heat-exchanging performance of the air-conditioning apparatus 1.

More specifically, the heat exchanger unit 42 according to one or more embodiments includes, on the air upstream side, the first heat exchanger 52 including the upper-side first heat exchanging region 500U and the lower-side first heat exchanging region 500L, and the second heat exchanger 62 on the air downstream side. The fourth header 624 on the air downstream side causes a refrigerant to flow out to the lower-side first header 523L on the air upstream side, and thus, when the heat exchanger unit 42 is used as a condenser, a refrigerant that flows in the second heat exchanger 62 on the air downstream side can be subcooled at the lower-side first heat exchanging region 500L on the air upstream side. Therefore, it is possible to increase the amount of the refrigerant that is to be subcooled.

(3-3-2)

In the heat exchanger unit 42 according to one or more embodiments, the gas-side connecting pipe (gas-refrigerant pipe) 6*a* that allows a gaseous refrigerant to flow therethrough is connected to the upper-side first header 523U and the third header 623, and the liquid-side connecting pipe (liquid-refrigerant pipe) 5*a* that allows a liquid refrigerant to flow therethrough is individually connected to the upper-side second header 524U and the lower-side second header 524L.

In the heat exchanger unit 42 having such a configuration, a direction of a refrigerant that flows in the upper-side first heat exchanging region 500U and a direction of a refrigerant that flows in the lower-side first heat exchanging region 500L are identical to each other, and thus, when the heat exchanger unit 42 is used as a condenser, the superheating region Sh1 and the subcooling region Sh2 can be formed at locations away from each other in the first heat exchanger 52. Consequently, it is possible to suppress a heat conduction loss and further increase a degree of subcooling of the refrigerant.

In addition, in the heat exchanger unit 42 having such a configuration, the liquid-side connecting pipe (liquid-refrigerant pipe) 5*a* is individually connected to the upper-side second header 524U and the lower-side second header 524L. The upper-side first header 523U and the upper-side second header 524U thus do not require an intermediate pipe. Consequently, due to the configuration that does not require such an extra intermediate pipe, when the heat exchanger unit is used as an evaporator, it is possible to reduce a refrigerant pressure loss and a drifting flow that are caused by an intermediate branching flow and an intermediate pipe. As a result, it is also possible to improve the performance as the evaporator in the heat exchanger unit 42 having the configuration according to one or more embodiments.

(3-3-3)

In the heat exchanger unit 42 according to one or more embodiments, the first direction D1 of a refrigerant flow from the upper-side first header 523U toward the upper-side second header 524U and the second direction D2 of a refrigerant flow from the third header 623 toward the fourth header 624 are opposite to each other. Thus, the heat exchanger unit 42 according to one or more embodiments can reduce temperature irregularity when used as a condenser or an evaporator.

Meanwhile, when the flow direction of a refrigerant that flows in the upper-side first heat exchanging region 500U and the flow direction of a refrigerant that flows in a second heat exchanging region (second flat pipe group 600) are opposite to each other, a temperature difference is not easily assured between air that passes through the first heat exchanger 52 and a refrigerant that flows in the second heat exchanger 62. In contrast, in the heat exchanger unit 42 that has the aforementioned configuration, the fourth header 624 on the air downstream side causes a refrigerant to flow out to the lower-side first header 523L on the air upstream side. Thus, when the heat exchanger unit 42 is used as a condenser, the subcooling region Sc2 of the second heat exchanger 62 can be disposed not to overlap from a space at the rear of the superheating region Sh1 of the first heat exchanger 52. Consequently, when the heat exchanger unit 42 is used as a condenser, it is possible to further increase, in the second heat exchanger 62, the amount of the refrigerant to be cooled at the subcooling region Sc2.

In the heat exchanger unit 42 that has the aforementioned configuration, the first header 523 on the air upstream side and the fourth header 624 on the air downstream side are close to each other. Consequently, it is possible to realize a structure that causes a refrigerant to easily flow out from the fourth header 624 to the lower-side first header 523L. Moreover, as a result of the fourth header 624 and the lower-side first header 523L being disposed close to each other, it becomes easy to manufacture the heat exchanger unit 42 that has a bent structure.

(3-3-4)

In the heat exchanger unit 42 according to one or more embodiments, the fourth header 624 includes the coupling pipes 427 and 428 configured to cause a refrigerant that flows in from the third header 623 to flow out to the lower-side first header 523L. If connecting ports of the coupling pipes 427 and 428 are adjusted so as to be connected at a lower portion of the fourth header 624 to the lower-side first header 523L, it is possible, when the heat exchanger unit 42 is used as an evaporator, to cause a refrigerant to flow so as to be blown up from below, and it is possible to reduce the drifting flow.

As discussed above, the temperature measurement device 1000 may be installed at each of the coupling pipes 427 and 428. Such a configuration enables the temperature of a refrigerant that flows in the second heat exchanger 62 to be grasped. The heat-exchanging performance of the air-conditioning apparatus 1 can be further improved by optimizing the state of the refrigerant on the basis of a value of measurement by the temperature measurement device.

The present invention is not limited to a configuration where the temperature measurement device 1000 is installed at each of the coupling pipes 427 and 428. For example, the temperature measurement device 1000 may additionally or alternatively be installed at the fourth header 624.

(3-3-5)

In the heat exchanger unit 42 according to one or more embodiments, the area of the upper-side first heat exchanging region 500U is larger than the area of the lower-side first heat exchanging region 500L. Consequently, the refrigerant flow rate at the lower-side first heat exchanging region 500L is increased, which improves heat-conduction efficiency.

(3-3-6)

Figure 14:
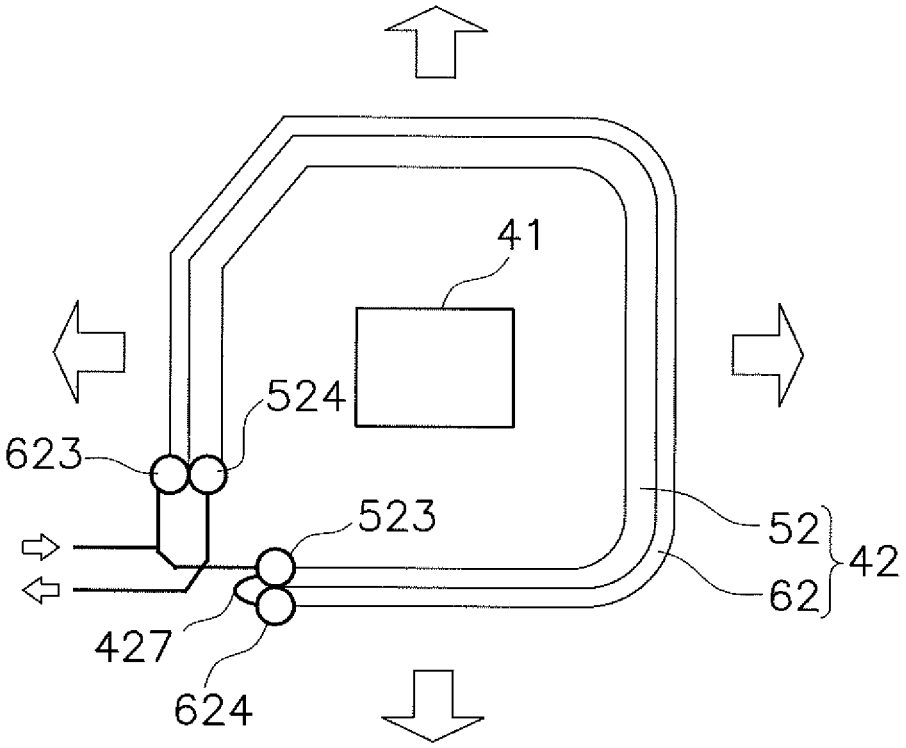
FIG. 14 is a schematic view illustrating a planar shape of the heat exchanger unit 42 according to one or more embodiments.

In the heat exchanger unit 42 according to one or more embodiments, each of the first heat exchanger 52 and the second heat exchanger 62 is bent between the headers. As illustrated in FIG. 14, the first heat exchanger 52 and the second heat exchanger 62 are each bent at least three portions thereof between the headers and each of the first heat exchanger 52 and the second heat exchanger 62 has a substantially quadrangular shape in plan view. The first heat exchanger 52 and the second heat exchanger 62 each have a shape that surrounds the indoor fan 41.

As a result of being thus bent between the headers, the heat exchanger unit 42 can be installed at a desired location. In particular, when the first heat exchanger 52 and the second heat exchanger 62 each have a substantially quadrangular shape in plan view, the air-conditioning apparatus 1 configured to supply conditioned air in a radial shape can be realized by installing the indoor fan 41 in the first heat exchanger 52 and the second heat exchanger 62.

Note that "substantially quadrangular shape" referred here does not mean only a complete quadrangular shape and means any shape that is formed by pairs of two sides parallel to each other. Accordingly, the quadrangular shape includes a quadrangular shape in which a corner portion or corner portions are rounded and a quadrangular shape in which a corner portion or corner portions are cut.

(3-3-7)

In the heat exchanger unit 42 according to one or more embodiments, as illustrated in FIG. 10, an inner portion of the second header 524 is partitioned by the partition plates 524*a* to 524*c*. Consequently, the heat exchanging region of the first flat pipe group 500 is divided into a plurality of regions, and a refrigerant drifting flow in the height (gravity) direction can be suppressed. The number of the partition plates in the second header 524 is not limited to the aforementioned number. Any number of the partition plates can be disposed.

(3-4) Modifications of Heat Exchanger Unit (3-4-1) Modification A

Figure 15:
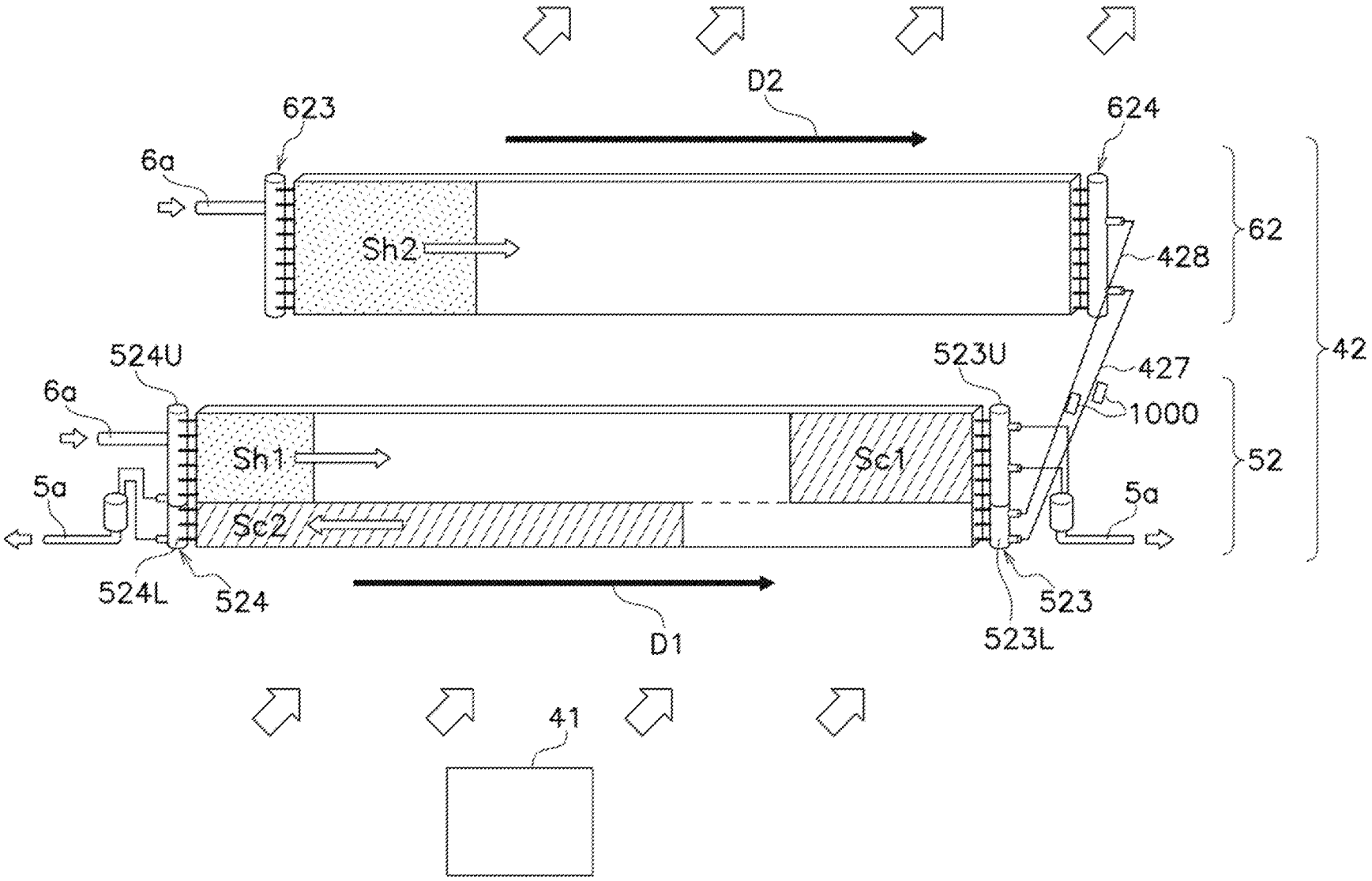
FIG. 15 is a schematic view illustrating a configuration of the heat exchanger unit 42 according to a modification A.

In the aforementioned description, the first direction D1 and the second direction D2 are opposite to each other; the heat exchanger unit 42 according to one or more embodiments is, however, not limited to this configuration. For example, as illustrated in FIG. 15, the first direction D1 and the second direction D2 may be identical to each other. Even in such a configuration, when the heat exchanger unit 42 is used as a condenser, the subcooling region Sc2 of the second heat exchanger 62 can be disposed not to overlap from the space at the rear of the superheating region Sh1 of the first heat exchanger 52. In the form of the modification A, a direction of a refrigerant that flows in the upper-side first heat exchanging region 500U and a direction of a refrigerant that flows in the lower-side first heat exchanging region 500L are opposite to each other.

(3-4-2) Modification B

In the aforementioned description, the headers 523, 524, 623, and 624 are formed by different members and, however, may be integrally formed with a header adjacent thereto. For example, in an example of the configuration illustrated in FIG. 8, the first header 523 and the fourth header 624, and the second header 524 and the third header 623 may be integrally formed. In short, in the heat exchanger unit 42 according to one or more embodiments, the headers may not be individual headers and may be realized by a single header provided that the header has the aforementioned functions.

(3-4-3) Modification C

In the aforementioned description, the heat exchanger unit 42 that has a structure in which the fourth header 624 and the lower-side first header 523L are coupled to each other by the coupling pipes 427 and 428 has been described; however, the heat exchanger unit 42 according to one or more embodiments is not limited to this configuration. For example, in the heat exchanger unit 42 according to one or more embodiments, the first header 523 and the fourth header 624 may be realized by a single header, and a coupling passage may be formed in the header, thereby coupling the fourth header 624 and the lower-side first header 523L to each other.

(3-4-4) Modification D

In the aforementioned description, a configuration includes the temperature measurement device that is installed at the coupling pipes 427 and 428; however, the heat exchanger unit 42 according to one or more embodiments is not limited to this configuration. For example, a configuration in which various measurement equipment other than the temperature measurement device is installed may be employed.

(3-4-5) Modification E

In the aforementioned description, a configuration includes the first heat exchanger 52 and the second heat exchanger 62 that have a substantially quadrangular shape in plan view; however, the heat exchanger unit 42 according to one or more embodiments is not limited to this configuration. For example, the heat exchanger unit 42 may be in a form of a flat plate shape or a form of a curved plate shape.

(3-4-6) Modification F

In the aforementioned description, the heat exchanger unit 42 of the ceiling-embedded type has been described; however, the heat exchanger unit according to one or more embodiments is not limited thereto. The heat exchanger unit 42 according to one or more embodiments is mountable, not only on an indoor unit of the ceiling-embedded type, but also on an indoor unit of a duct type, a ceiling-suspended type, or the like.

OTHER EMBODIMENTS

The embodiments of the present invention and the modifications thereof have been described above on the basis of the drawings; however, a specific configuration is not limited to these embodiments and the modifications thereof and is changeable within a range not deviating from the gist of the invention.

REFERENCE SIGNS LIST

5*a* liquid-side connecting pipe (liquid-refrigerant pipe)
6*a* gas-side connecting pipe (gas-refrigerant pipe)
41 indoor fan (fan)
42 heat exchanger unit
427 coupling pipe
428 coupling pipe
52 first heat exchanger
62 second heat exchanger
500 first flat pipe group
500L lower-side first heat exchanging region
500U upper-side first heat exchanging region
523 first header
523L lower-side first header
523U upper-side first header
524 second header
524L lower-side second header
524U upper-side second header
600 second flat pipe group
623 third header
624 fourth header
D1 first direction
D2 second direction Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger unit comprising:
a first heat exchanger comprising:
a first header;
a second header; and
a first flat pipe group that comprises a first group of flat multi-hole pipes, wherein
flat multi-hole pipes of the first group are aligned in an up-down direction and are connected to each of the first header and the second header; and
a second heat exchanger:
disposed in parallel with the first heat exchanger on an air downstream side, from the first heat exchanger, of air flow generated by a fan; and
comprising:
a third header;
a fourth header; and
a second flat pipe group that comprises a second group of flat multi-hole pipes, wherein
flat multi-hole pipes of the second group are connected to each of the third header and the fourth header, wherein
an upper-side first heat exchanging region comprises one or more of the flat multi-hole pipes of the first group on an upper side of the up-down direction,
a lower-side first heat exchanging region comprises one or more of the flat multi-hole pipes of the first group on a lower side of the up-down direction,
the upper-side first heat exchanging region is larger than the lower-side first heat exchanging region, the first header comprises:

an upper-side first header connected to the upper-side first heat exchanging region; and a lower-side first header connected to the lower-side first heat exchanging region, the fourth header causes a refrigerant that flows in from the third header to flow out to the lower-side first header.

2. The heat exchanger unit according to claim 1, wherein the second header comprises:

an upper-side second header connected to the upper-side first heat exchanging region; and a lower-side second header connected to the lower-side first heat exchanging region, a gas-refrigerant pipe through which gaseous refrigerant flows is connected to the upper-side first header and the third header, and liquid-refrigerant pipes through which liquid refrigerant flows, wherein one of the liquid-refrigerant pipes is connected to the upper-side second header and another of the liquid-refrigerant pipes is connected to the lower-side second header.

3. The heat exchanger unit according to claim 2, wherein a first direction of a refrigerant flow from the upper-side first header toward the upper-side second header is opposite to a second direction of a refrigerant flow from the third header toward the fourth header.

4. The heat exchanger unit according to claim 1, further comprising:

a coupling pipe that couples the fourth header to the first header.

5. The heat exchanger unit according to claim 4, further comprising:

a temperature sensor that measures a temperature of the refrigerant and that is disposed at the coupling pipe.

6. The heat exchanger unit according to claim 1, wherein at least three portions of the first heat exchanger are bent between the first header and the second header, at least three portions of the second heat exchanger are bent between the third header and the fourth header, and the first heat exchanger and the second heat exchanger have a quadrangular shape in a plan view of the heat exchanger unit.

7. The heat exchanger unit according to claim 6, wherein the first heat exchanger and the second heat exchanger surround the fan.

* * * * *